US010526812B1

(12) United States Patent
Vogeler

(10) Patent No.: US 10,526,812 B1
(45) Date of Patent: Jan. 7, 2020

(54) ELECTRIC FENCE WIRE REEL APPARATUS

(71) Applicant: Craig A. Vogeler, North Loup, NE (US)

(72) Inventor: Craig A. Vogeler, North Loup, NE (US)

( * ) Notice: Subject to any disclaimer, the term of this patent is extended or adjusted under 35 U.S.C. 154(b) by 10 days.

(21) Appl. No.: 16/034,615

(22) Filed: Jul. 13, 2018

(51) Int. Cl.

| | |
|---|---|
| ***E04H 17/26*** | (2006.01) |
| ***B65H 75/42*** | (2006.01) |
| ***B65H 75/30*** | (2006.01) |
| ***A01K 3/00*** | (2006.01) |

(52) U.S. Cl.
CPC ..... *E04H 17/266* (2013.01); *A01K 3/005* (2013.01); *B65H 75/305* (2013.01); *B65H 75/425* (2013.01)

(58) Field of Classification Search
CPC .. B65H 75/305; B65H 75/425; E04H 17/266; A01K 3/005
See application file for complete search history.

(56) References Cited

U.S. PATENT DOCUMENTS

| | | | | |
|---|---|---|---|---|
| 8,702,029 | B1 * | 4/2014 | Thompson | B65H 49/321 242/403 |
| 8,827,198 | B1 * | 9/2014 | Steadman, Sr. | B65H 75/305 242/118.6 |
| 9,874,040 | B1 * | 1/2018 | Smith | E04H 17/266 |
| 2003/0234316 | A1 * | 12/2003 | Sloan | B65H 75/242 242/573.9 |
| 2011/0127481 | A1 * | 6/2011 | Petty | E04H 17/266 256/37 |

* cited by examiner

*Primary Examiner* — Sang K Kim
(74) *Attorney, Agent, or Firm* — Dennis L. Thomte; Thomte Patent Law Office LLC

(57) ABSTRACT

An electric fence wire reel which may be secured to a vertically disposed post or secured to a drawbar which is secured to a receiver tube of a hitch mounted at the rearward end of a vehicle.

6 Claims, 6 Drawing Sheets

ELECTRIC FENCE WIRE REEL APPARATUS

BACKGROUND OF THE INVENTION

Field of the Invention

This invention relates to an electric fence wire reel apparatus and more particularly to an electric fence wire reel apparatus which may be secured to a hitch receiver at the rearward end of an ATV or the like or which may be secured to a vertically disposed post.

Description of the Related Art

Electric fence wires have long been used to fence areas such as corn stalk fields to maintain the cattle therein for a period of time. The electric fences are frequently moved to other locations. Usually, the fences are moved to another location by first removing the posts which support the electric wire thereon and then winding the fence wire onto a reel or the like. The reels are normally supported on a post during the rewinding of the fence wire. An example of an electric fence wire reel is marketed by Premier 1 Supplies. However, the reel of Premier 1 is mounted on a post and is not designed to be secured to a hitch receiver mounted on an ATV or the like. Further, the reel of Premier 1 can only be operated from one side of the reel due to the design of the reel mounting frame thereof.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An electric fence wire reel apparatus for attachment to the receiver tube of a hitch mounted at the rear end of an ATV or the like is disclosed. The apparatus includes a drawbar including a horizontally disposed forward drawbar section having a forward end and a rearward end with the forward end of the forward drawbar section being configured to be slidably received in and secured to the receiver tube of the hitch. The drawbar also includes a rearward drawbar section having a forward end and a rearward end with the rearward drawbar section extending upwardly and rearwardly from the rearward end of the forward drawbar section.

A first mounting plate is secured to the rearward end of the rearward drawbar section with the first mounting plate having a plurality of bolt openings formed therein. The apparatus also includes a reel support frame having a forward end and a rearward end. A second mounting plate is secured to the forward end of the reel support frame with the second mounting plate having a plurality of bolt openings formed therein. The second mounting plate is selectively secured to the first mounting plate by bolts extending through the bolt openings in the first and second mounting plates.

The reel support frame includes first and second horizontally spaced-apart axle supports at the rearward end thereof. A fence wire reel is provided which includes an axle having a first end and a second end. A circular first flange is secured to the axle inwardly of the first end thereof for rotation therewith with the first flange having an inner side and an outer side. A circular second flange is secured to the axle inwardly of the second end thereof for rotation therewith with the second flange having an inner side and an outer side. The first end of the axle is selectively rotatably received in the first axle support. The second end of the axle is selectively rotatably received in the second axle support. Each of the first and second ends of the axle are configured to have an electric drill secured thereto outwardly of the respective axle supports for selectively rotating the fence wire reel.

The reel support frame and the fence wire reel may be separated from the drawbar and used on a vertically disposed post.

It is therefore a principal object of the invention to provide an improved electric fence wire reel apparatus.

A further object of the invention is to provide an electric fence wire reel apparatus which may be attached to the receiver tube of a hitch mounted at the rear end of an ATV or the like.

A further object of the invention is to provide an electric fence wire reel which may be attached to a vertically disposed post.

A further object of the invention is to provide an electric fence wire reel which may be rotated from either side of the reel.

A further object of the invention is to provide an electric fence wire reel apparatus which may be rotated by a battery operated electric drill from either side of the reel.

A further object of the invention is to provide an electric fence wire reel apparatus which is convenient to use and which is safe to use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
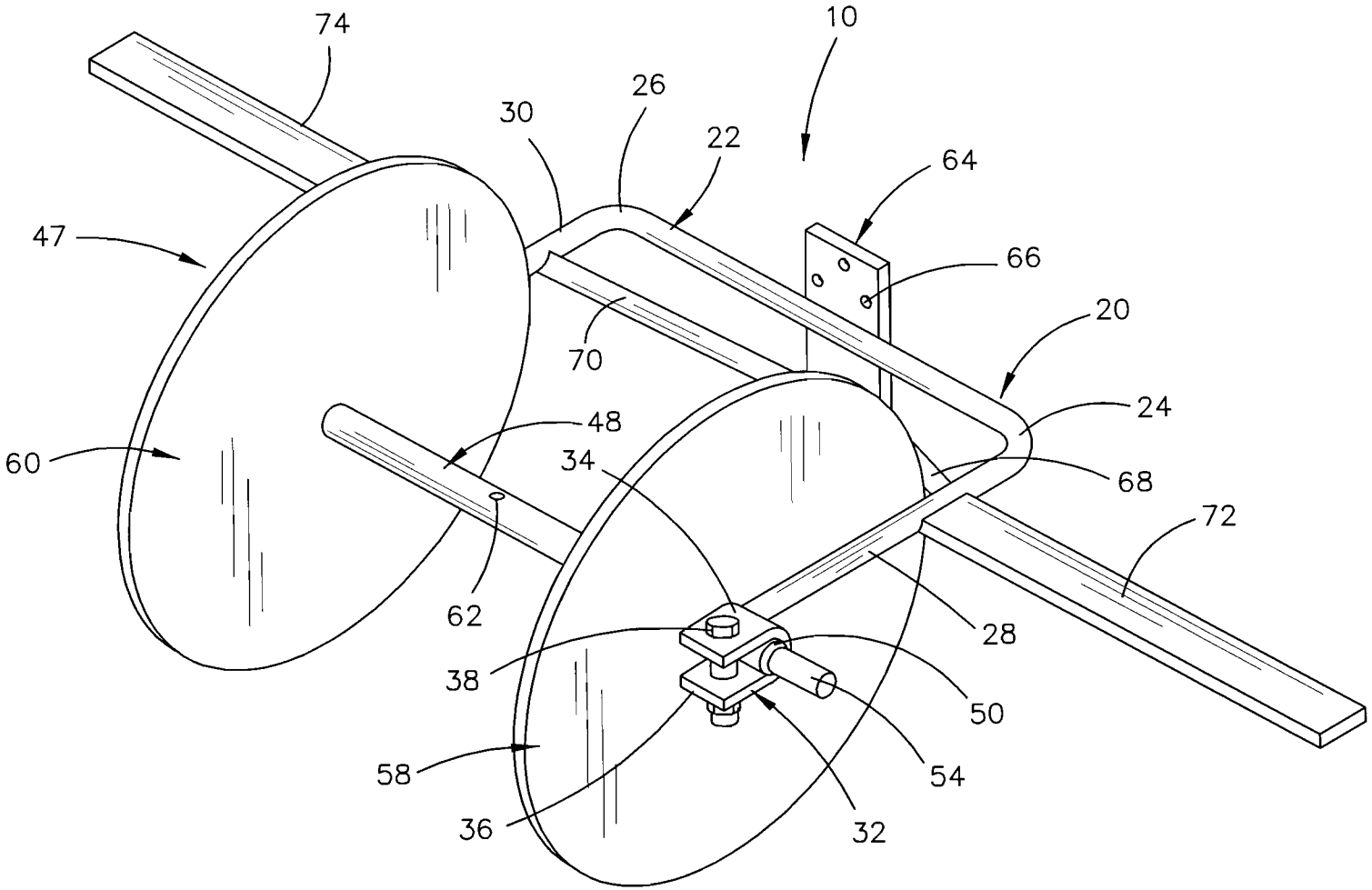
FIG. 1 is a rear perspective view of the invention.
Figure 2:
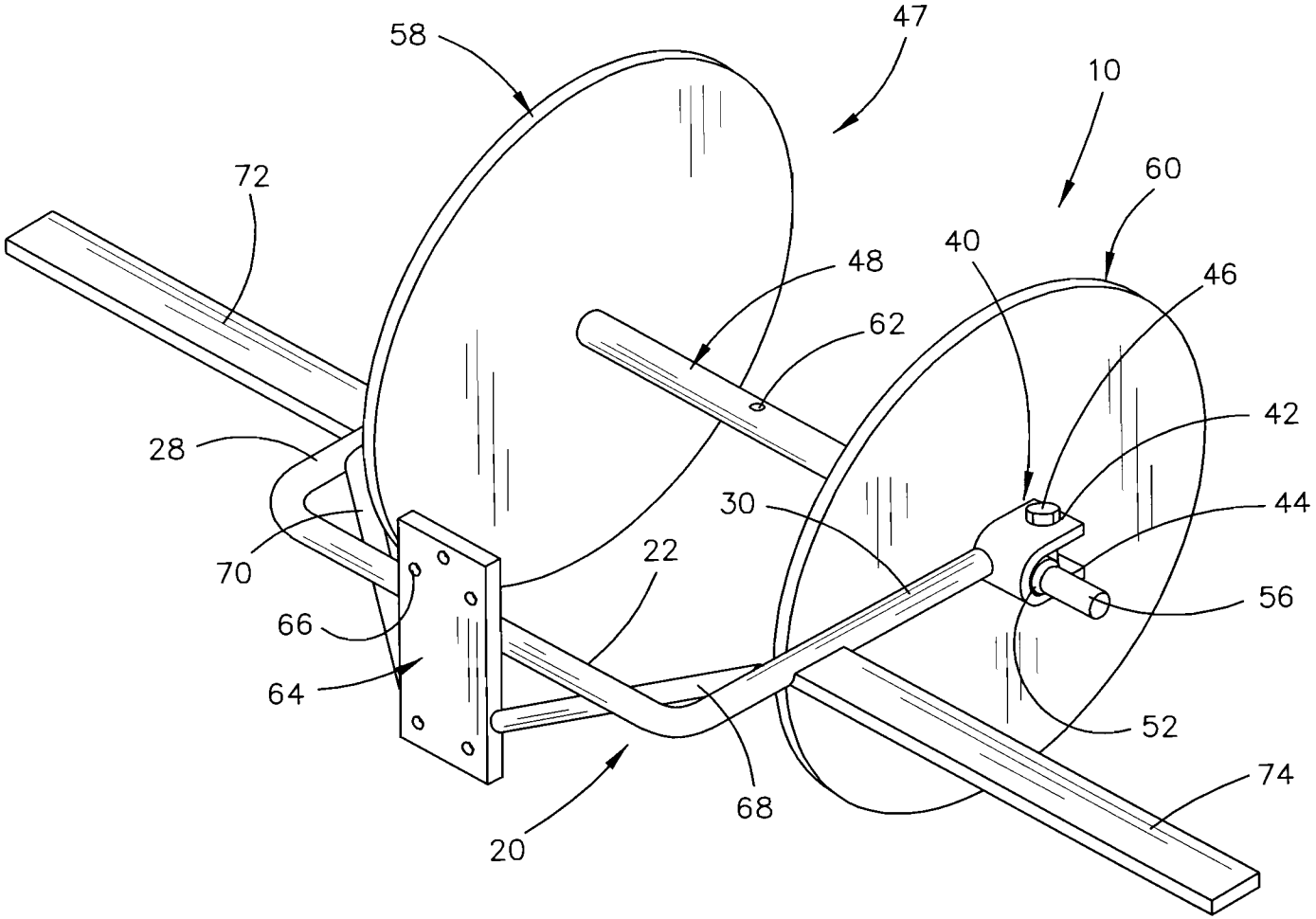
FIG. 2 is a front perspective view of the invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The electric fence wire reel apparatus of this invention is designated with the reference numeral 10. Apparatus 10 may be mounted on a vertically disposed post 11 or may be attached to a drawbar 12 which is secured to the receiver tube 14 of a hitch 16 secured to the rearward end of an ATV 18 or the like. Apparatus 10 will initially be described as being attached to the receiver tube 14 of a hitch 16 mounted on an ATV or the like.

Apparatus 10 includes a reel support frame 20 having a transversely extending frame member 22 at its forward end which has ends 24 and 26. Reel support frame 20 also includes an elongated frame member 28 which extends rearwardly from end 24 of frame member 22 and an elongated frame member 30 which extends rearwardly from end 26 of frame member 22. The rearward end of frame member 28 has a U-shaped member 32 welded thereto which has rearwardly extending legs 34 and 36, each of which has a bolt opening formed therein which is adapted to receive a bolt 38. The rearward end of frame member 30 has a U-shaped member 40 welded thereto which has rearwardly extending legs 42 and 44, each of which has a bolt opening formed therein which is adapted to receive a bolt 46.

The numeral 47 refers to the reel of this invention. Reel 47 includes an elongated axle 48 having ends 50 and 52. Ends 50 and 52 of axle 48 have reduced diameter portions 54 and 56 respectively. A first circular flange 58 is welded to axle 48 inwardly of end 50 of axle 48. A second circular flange 60 is welded to axle 48 inwardly of end 52 of axle 48. Preferably, axle 48 has a central opening 62 formed therein.

As seen, the ends 50 and 52 of axle 48 are rotatably mounted in the U-shaped members 32 and 40 respectively. The bolts 38 and 46 maintain the ends 50 and 52 of axle 48 in the U-shaped members 32 and 40 respectively.

The numeral 64 refers to a mounting plate which is welded to frame member 22 and which has bolt openings 66 formed therein. A reinforcing rod 68 has one end secured to plate 64 and its other end secured to frame member 28. A reinforcing rod 70 has one end secured to plate 64 and its other end secured to frame member 30.

An elongated support member 72 has its inner end secured to frame member 28 and extends horizontally outwardly therefrom. An elongated support member 74 has its inner end secured to frame member 30 and extends horizontally outwardly therefrom.

As stated, apparatus 10 is designed to be secured to the receiver tube 14 of a vehicle such as the ATV 18. Apparatus 10 includes the drawbar 12 which includes a horizontally disposed forward drawbar section 76 which is slidably received by the receiver tube 14 and secured thereto in conventional fashion. Drawbar 12 includes a rearward drawer section 78 which extends upwardly and rearwardly from the rearward end of drawbar section 76. In some cases, drawbar section 78 is not needed. A mounting plate 80 is secured to the rearward end of drawbar section 78 and has a plurality of bolt openings formed therein which register with the bolt openings in mounting plate 64. Bolts 82 connect the plates 64 and 80 together. The numeral 84 refers to a battery operated drill of conventional design.

Assuming that the apparatus 10 is mounted on an ATV 18, the apparatus 10 functions as will now be described. The electric fence wire 86 is disconnected from the posts supporting the same. One end of the wire 86 will be inserted into the opening 62 in axle 48. The chuck of the drill 84 will be secured to either of the reduced diameter portions 54 and 56. The drill 84 will then be activated to rotate the reel 47 to wind the wire 86 onto the reel 47. The winding operation may be conducted from either side of the apparatus 10. The support members 72 and 74 may be used to support the drill 84 thereon or the hand of the person winding the wire 86.

Figure 3:
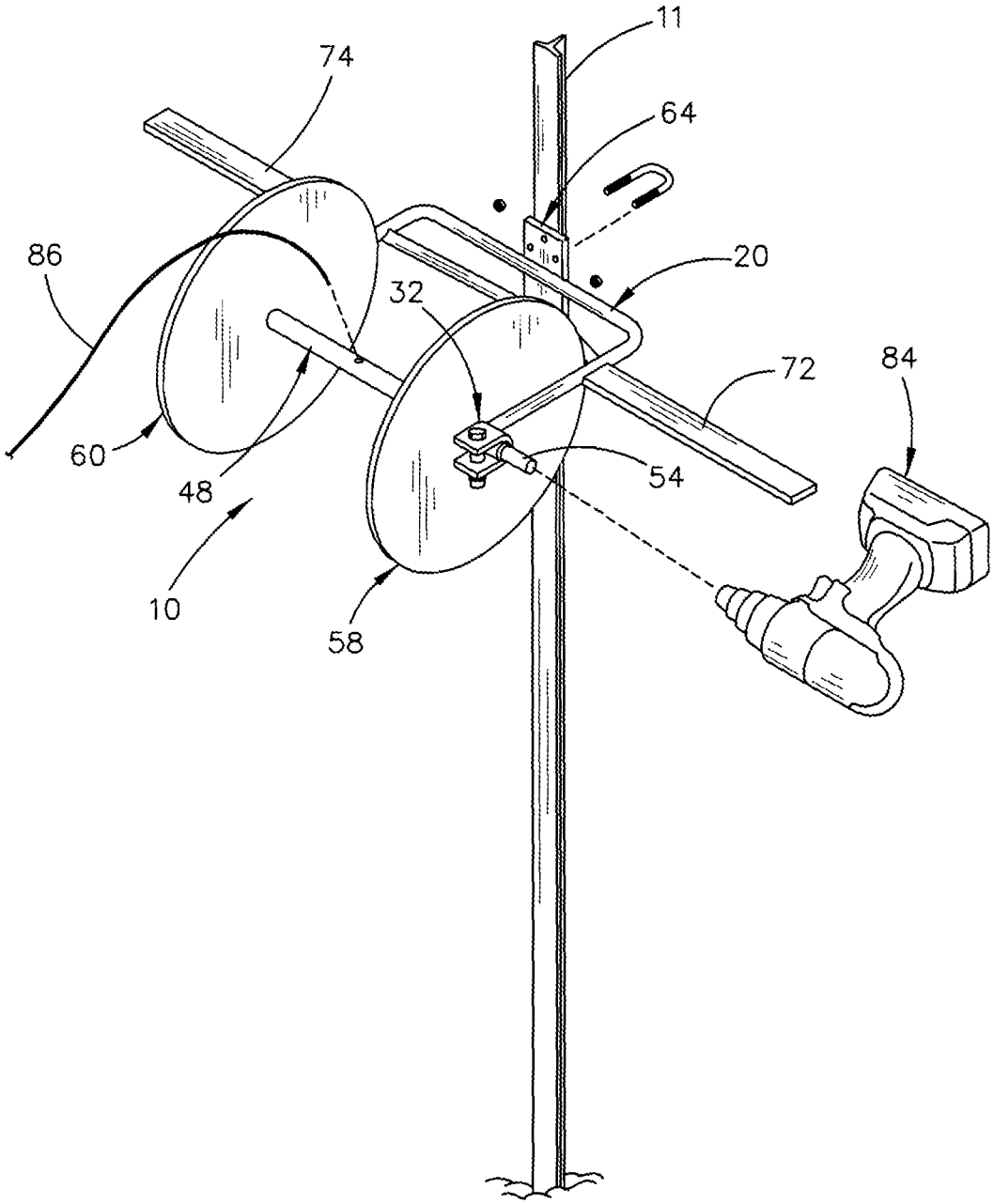
FIG. 3 is a partial exploded front perspective view of the invention mounted on a post.
Figure 4:
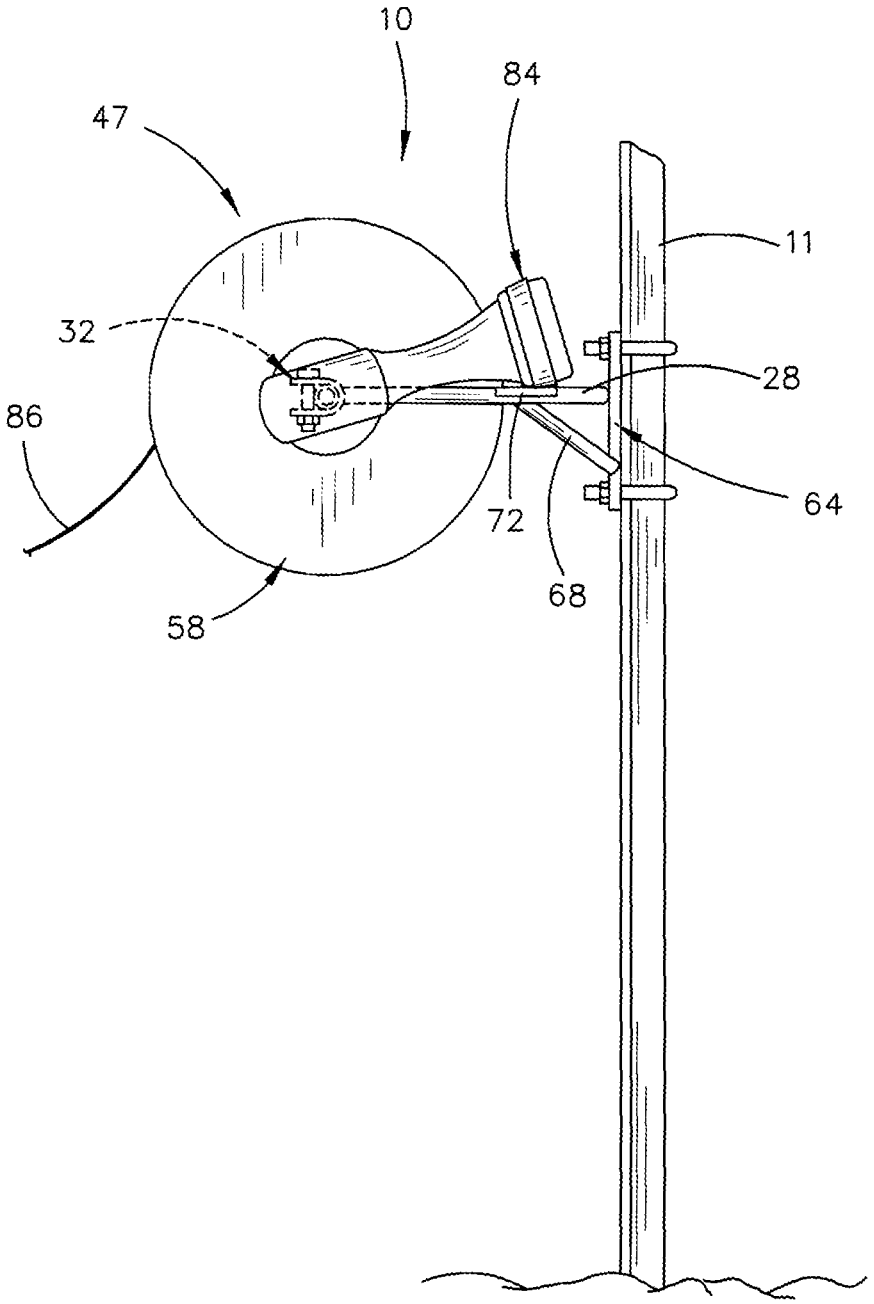
FIG. 4 is a side elevational view of the invention mounted on a post.
Figure 5:
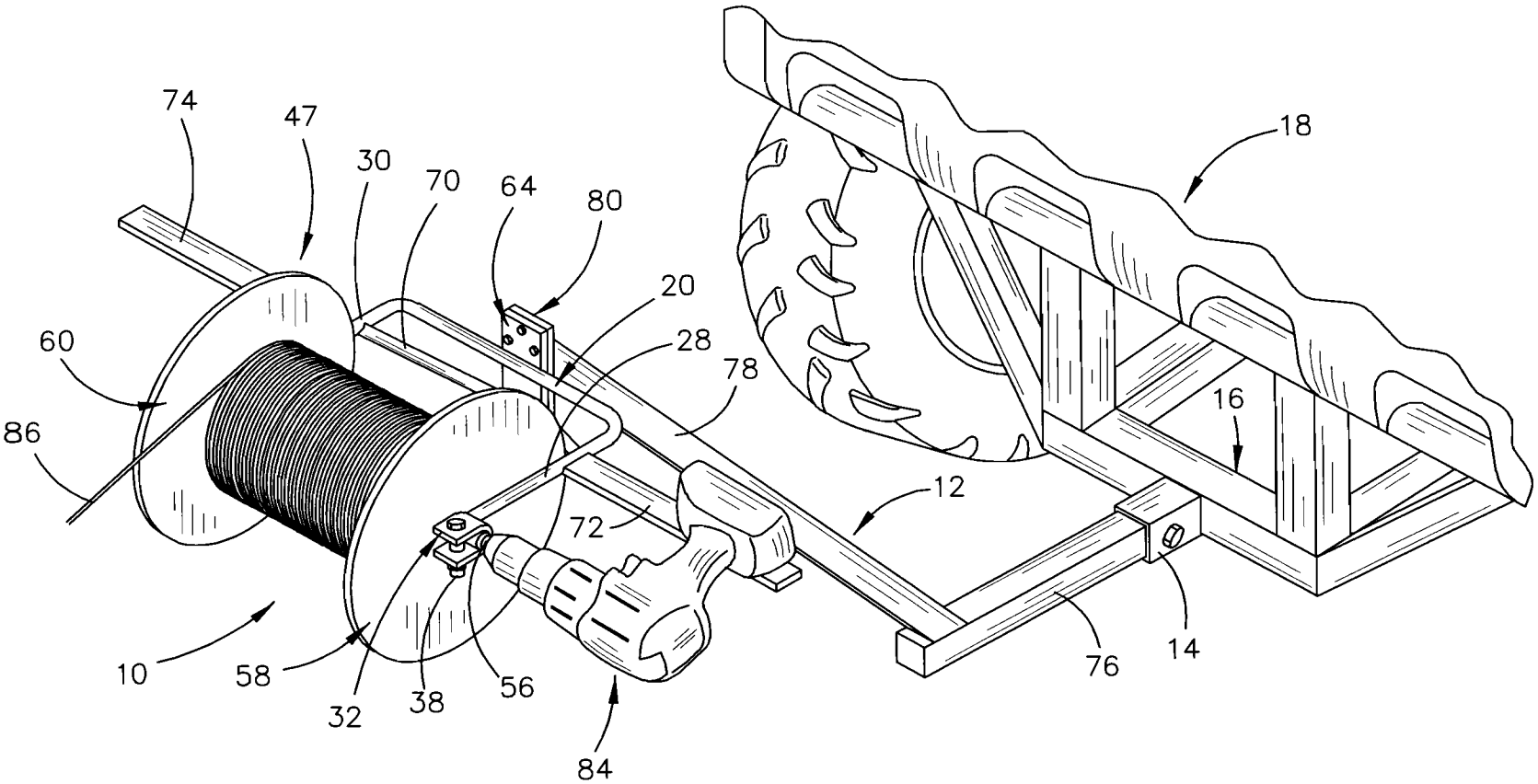
FIG. 5 is a rear perspective view of the invention mounted on a drawbar which is secured to a hitch receiver tube mounted at the rear end of an ATV.
Figure 6:
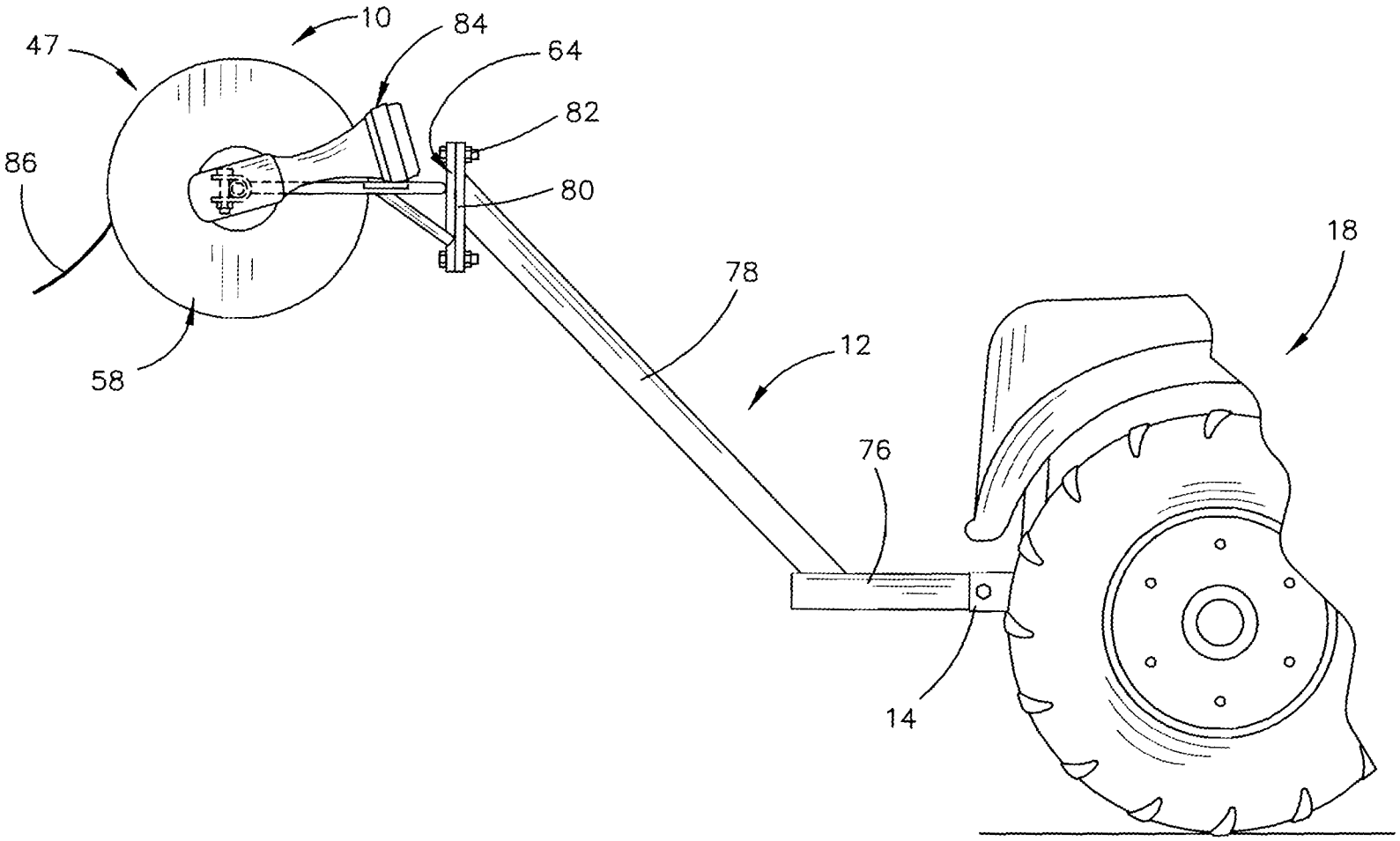
FIG. 6 is a side elevational view of the invention mounted on a drawbar which is secured to a hitch receiver tube mounted at the rear end of an ATV.

If the apparatus 10 is going to be used with a post 11 rather than the ATV 18, mounting plate 64 is disconnected from the mounting plate 80. The mounting plate 64 will then be secured to a post 11 as seen in FIG. 3. The reel 47 will be rotated by the drill 84 as described above to wind the wire 86 onto the reel 47. When the wire 86 has been wound onto the reel 47, the bolts 38 and 46 may be removed so that the reel may be lifted from the frame 20 for storage or use.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An electric fence wire reel apparatus for attachment is a receiver tube of a hitch mounted at the rear end of an ATV, comprising:

a drawbar including a horizontally disposed forward drawbar section having a forward end and a rearward end;

said forward end of said forward drawbar section being configured to be slidably received in and secured to the receiver tube of the hitch;

said drawbar also including a rearward drawbar section having a forward end and a rearward end;

said rearward drawbar section extending upwardly and rearwardly from said rearward end of said forward drawbar section;

a first mounting plate secured to said rearward end of said rearward drawbar section;

said first mounting plate having a plurality of bolt openings formed therein;

a reel support frame having a forward end and a rearward end;

said reel support frame including a transversely extending and elongated first frame member, having first and second ends, an elongated second frame member, having forward and rearward ends, which extends rearwardly from said first end of said first frame member, and an elongated third frame member, having forward and rearward ends, which extends rearwardly from said second end of said first frame member;

a second mounting plate secured to said forward end of said reel support frame;

said second mounting plate having a plurality of bolt openings formed therein;

said second mounting plate being secured to said first mounting plate by bolts extending through said bolt openings in said first and second mounting plates;

said reel support frame including first and second horizontally spaced-apart U-shaped members at said rearward ends of said reel second and third frame members of said support frame;

a fence wire reel including a circular first flange and a circular second flange spaced from said first flange;

said first flange having an inner side and an outer side;

said second flange having an inner side and an outer side;

an elongated axle, having first and second ends, extending through said first flange and said second flange;

said first and second flanges being secured to said axle therewith;

said axle having a first end portion which is positioned outwardly of said outer side of said first flange;

said axle having a second end portion which is positioned outwardly of said outer side of said second flange;

said first end portion of said axle being selectively rotatably received in said first U-shaped member;

said second end portion of said axle being selectively rotatably received in said second U-shaped member; and each of said first and second end portions of said axle being configured to have an electric drill secured thereto outwardly of said axle supports for selectively rotating said fence wire reel.

2. The electric fence wire reel apparatus of claim 1 wherein said second mounting plate may be detached from said first mounting plate whereby said second mounting plate may be secured to a vertically disposed post so that said reel support frame and said fence wire reel may be mounted on the post.

3. The electric fence wire reel apparatus of claim 1 wherein a first elongated support is secured to said reel support frame and which extends outwardly therefrom forwardly of said first flange.

4. The electric fence wire reel apparatus of claim 3 wherein a second elongated support is secured to said reel support frame and which extends outwardly therefrom forwardly of said second flange.

5. An electric fence wire reel apparatus for attachment to a receiver tube of a hitch mounted at the rear end of an ATV, comprising:

a drawbar having a forward end and a rearward end;

said forward end of said drawbar being configured to be slidably received in and secured to the receiver tube of the hitch;

a reel support frame having a forward end and a rearward end;

said reel support frame including first and second horizontally spaced-apart U-shaped members at said rearward end of said reel support frame;

a circular first flange;

said first flange having an inner side and an outer side;

a circular second flange;

said second flange having an inner side and an outer side;

said first and second flanges being spaced from one another;

an elongated axle, having first and second ends, extending through said first flange and said second flange;

said axle being fixed to said first flange and said second flange for rotation therewith;

said axle having a first end portion which is positioned outwardly of said outer side of said first flange;

said axle having a second end portion which is positioned outwardly of said outer side of said second flange;

said first end portion of said axle being selectively rotatably received in said first U-shaped member;

said second end portion of said axle being selectively rotatably received in said second U-shaped member;

said first flange, said second flange and said axle comprising a fence ire reel which is rotatably mounted on said reel support frame; and each of said first and second end portions of said axle being configured to have an electric drill secured thereto outwardly of said axle supports for selectively rotating said fence wire reel.

6. An electric fence wire reel apparatus, comprising:

a reel support frame having a forward end and a rearward end;

a mounting plate mounted on said forward end of said reel support frame;

said reel support frame including first and second horizontally spaced-apart U-shaped members at said rearward end of said reel support frame;

a fence wire reel including a circular first flange and a circular second flange;

said first flange having an inner side and an outer side;

said second flange having an inner side and an outer side;

an elongated axle, having first and second ends, extending through said first flange and said second flange;

said first flange and said second flange being fixed to said axle for rotation therewith;

said axle having a first end portion which is positioned outwardly of said outer side of said first flange;

said axle having a second end portion which is positioned outwardly of said outer side of said second flange;

said first end portion of said axle being selectively rotatably received in said first U-shaped member;

said second end portion of said axle being selectively rotatably received in said second U-shaped member;

each of said first and second end portions of said axle being configured to have an electric drill secured thereto outwardly of said U-shaped member for selectively rotating said fence wire reel; and said mounting plate configured to be secured to a vertically disposed post.

* * * * *